United States Patent [19]
Nnadi
[11] 4,076,636
[45] Feb. 28, 1978

[54] OVERBASED POLYARYLAMINE-ARYLHYDROXY (ALKOXY) SULFIDES AND LUBRICANT COMPOSITIONS CONTAINING SAME

[75] Inventor: John C. Nnadi, Lagos, Nigeria

[73] Assignee: Mobil Oil Corporation, New York, N.Y.

[21] Appl. No.: 646,126

[22] Filed: Jan. 2, 1976

[51] Int. Cl.[2] ..... C10M 1/10

[52] U.S. Cl. ..... 252/25; 252/18; 252/40.5; 252/42.7; 252/46.4; 252/400 R; 252/400 A; 260/570.5 R; 260/570.5 S

[58] Field of Search ..... 252/33, 18, 25, 33.4, 252/40.5, 42.7, 46.4, 46.7, 400 R, 400 A; 260/570.5 R, 570.5 S

[56] References Cited

U.S. PATENT DOCUMENTS

| | | | |
|---|---|---|---|
| 2,263,445 | 11/1941 | Reiff | 252/46.4 |
| 2,402,448 | 6/1946 | Richards | 252/42.7 |
| 2,434,396 | 1/1948 | Cook et al. | 252/42.7 X |
| 2,472,517 | 6/1949 | Cantrell et al. | 252/42.7 |
| 2,721,176 | 10/1955 | Cantrell et al. | 252/46.4 |
| 2,848,444 | 8/1958 | Bruggmann et al. | 252/47 |
| 3,105,049 | 9/1963 | Voorhees | 252/18 X |
| 3,262,880 | 7/1966 | Voorhees | 252/18 X |
| 3,632,600 | 1/1972 | Morris | 252/33 |
| 3,844,956 | 10/1974 | Nnadi | 252/46.7 |

*Primary Examiner*—Delbert E. Gantz
*Assistant Examiner*—Andrew H. Metz
*Attorney, Agent, or Firm*—Charles A. Huggett; Dennis P. Santini

[57] ABSTRACT

Oil-soluble overbased polyarylamine-arylhydroxy (alkoxy) sulfides and overbased organic and inorganic metallic salts, complexes, mixed salts and mixed salt complexes of polyarylamine-arylhydroxy (alkoxy) sulfides are provided. Said overbased compounds function as high temperature detergents and dispersants and lubricants are stabilized against oxidation and have their wear protection properties improved by adding thereto a property improving amount of one or more of said compounds.

13 Claims, No Drawings

OVERBASED POLYARYLAMINE-ARYLHYDROXY (ALKOXY) SULFIDES AND LUBRICANT COMPOSITIONS CONTAINING SAME

BACKGROUND OF THE INVENTION

1. Field of the Invention

The present invention relates to a new class of oil-soluble overbased compounds identified as overbased polyarylaminearylhydroxy (alkoxy) sulfides and overbased organic and inorganic metallic salts, complexes, mixed salts and mixed salt-complexes of polyarylamine-arylhydroxy (alkoxy) sulfides. It further relates to improved lubricant compositions. More particularly, it relates to lubricants which have been improved by the addition thereto of one or more of said above overbased compounds.

2. Discussion of the Prior Art

It is well known that many organic liquids and solids used in industrial fluids, such as oils and greases, power transmission fluids and the like, may deteriorate and lose their ability to function when subjected to oxidation. Since these substances are very often used at high temperatures, the rate of oxidative breakdown can be very rapid. This problem is particularly important in the operation of present day automotive and aircraft engines.

The breakdown of lubricant is almost always accompanied by the formation of sludge, corrosive acids and other products. These can harm the metal surfaces of engines or other machines and interfere with efficient operation of the lubricant.

No art is known which discloses the compounds taught herein. There are numerous other compounds, however, taught in the art which impart property improvement to lubricants in combination therewith. For instance, U.S. Pat. Nos. 3,156,728 and 3,224,972 teach 4,4-thiobis[2,6-di(lower alkyl)aniline] compounds for the purpose of imparting antioxidant properties to organic compositions therewith. Further, U.S. Pat. No. 2,848,444 teaches lubricant compositions containing a reaction product of a metal polysulfide and diphenylamine, or an alkyl derivative thereof, having improved oxidation and corrosion properties. U.S. Pat. No. 3,217,038 teaches the use of an alkylthioalkyl diaminodiphenylalkane for the purpose of imparting stabilization to an organic substance by mixture therewith. Also, U.S. Pat. No. 3,347,792 teaches lubricant compositions containing a reaction product of (1) ammonia, a primary amine or a secondary amine with (2) carbon disulfide and (3) an aliphatic epoxide. U.S. Pat. No. 3,844,956 teaches stabilization of lubricants by adding thereto an amino-substituted polyphenylthioether.

SUMMARY OF THE INVENTION

In accordance with this invention there is provided the new class of compounds identified as overbased polyarylaminearylhydroxy (alkoxy) sulfides and overbased organic and inorganic metallic salts, complexes, mixed salts and mixed salt-complexes of polyarylamine-arylhydroxy (alkoxy) sulfides. The overbased compounds of the present invention are prepared by reacting a polyarylamine-arylhydroxy (alkoxy) sulfide, hereinafter more particularly defined, or an organic or inorganic metallic salt, complex, mixed salt or mixed salt-complex thereof with one or more basic metallic compounds, such as, for example, LiOH, KOH, $Mg(OH)_2$, $Ca(OH)_2$, $Sr(OH)_2$ and/or $Ba(OH)_2$. The reaction with the basic metallic compounds may be in the presence of $CO_2$ and methanol or other promoters known in the art to produce compounds with more than stoichiometric amounts of metal.

The polyarylamine-arylhydroxy (alkoxy) sulfide for use in preparing the present overbased compounds has the following general chemical formula:

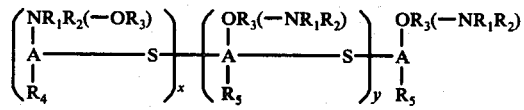

wherein $x$ is an integer of from 1 to about 10, preferably from 1 to about 5;

$y$ is an integer of from 0 to about 10, preferably from 0 to about 5;

A is an aromatic moiety, preferably phenyl or naphthyl;

$R_1$ and $R_2$ are alkyl of from 1 to about 10 carbon atoms, aryl, hydrogen,

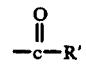

or combinations thereof;

R′ is alkyl of from 1 to about 10 carbon atoms, aryl or hydrogen; and $R_3$, $R_4$ and $R_5$ are hydrogen, alkyl of from 1 to about 200 carbon atoms, aryl, alkyl-substituted aryl where the alkyl substituent is comprised of from 1 to about 200 carbon atoms, carboxyaryl, carbonylaryl, aminoaryl, mercaptoaryl, halogenoaryl or combinations thereof.

The complexes of the polyarylamine-arylhydroxy (alkoxy) sulfide for use in preparing the present overbased compounds are of the following general structures with respect to complex segments of the sulfide compound wherein M is a polyvalent metal, such as, for example, Be, Mg, Ca, Ba, Mn, Co. Ni, Pd, Cu, Zn and Cd; and X is a radial selected from the group consisting of organophosphoro, organocarboxyl, organoamine, organosulfonyl, organothio, organooxy, nitrate, nitrite, phosphate, sulfate, sulfonate, oxide, hydroxide, carbonate, sulfite, fluoride, chloride, bromide and iodide:

1. Complexing metal function between nitrogen functions of either the same or different molecules of the compounds, i.e., either intra- or intermolecular, as follows:

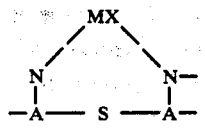

(intramolecular)

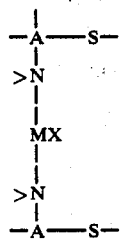

(intermolecular)

2. Complexing metal function between a nitrogen function and an oxygen function of the same or different molecules of the compounds as follows:

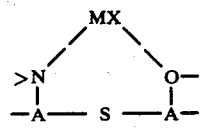

(intramolecular)

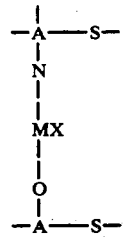

(intermolecular)

3. Complexing metal function between oxygen functions of either the same or different molecules of the compounds as follows:

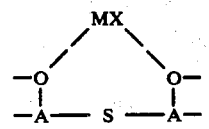

(intramolecular)

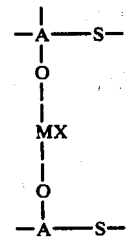

(intermolecular)

The salts and mixed salts of the polyarylaminearylhydroxy (alkoxy) sulfide for use in preparing the present overbased compounds are of the following general structures with $R_3$ being hydrogen at the participating oxygen functions and wherein M is as above defined and D is a monovalent metal, such as Na, K, Li, Rb and Cs:

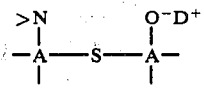

(1)

2. With oxygen functions of either the same or different compounds participating as follows:

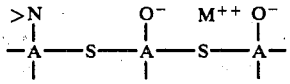

(intramolecular)

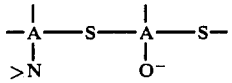

(intermolecular)

The mixed salt-complexes of the polyarylaminearylhydroxy (alkoxy) sulfide for use in preparing the present overbased compounds have general structures which comprise combinations of any of the above salt and complex general structures with the above requirements for salt and/or complex parts of the mixed salt-complex compounds remaining true.

It is noted that the $—NR_1R_2$ functions of the compounds may be the same or different within an individual molecule of the compounds of the present invention. Also, salts of this invention do not involve the nitrogen functions or the oxygen functions when $R_3$ is other than hydrogen for the participating oxygen function.

Also in accordance herewith, there is provided a lubricant composition comprising a major proportion of a lubricant and an antioxidant amount of one or more of the above oil-soluble overbased compounds.

DESCRIPTION OF SPECIFIC EMBODIMENTS

The polyarylamine-arylhydroxy (alkoxy) sulfide compounds for use in preparing the overbased compounds of the present invention may be prepared by methods known in the art. The salts, complexes, mixed salts and mixed salt-complexes may be prepared by known salt and/or complex forming methods.

Overbased compounds of the present invention may be made by the general method of reacting a polyarylamine-arylhydroxy (alkoxy) sulfide or an organic or inorganic metallic salt, complex, mixed salt or mixed salt-complex thereof with a suitable overbasing reactant, such as, for example, NaOH, LiOH, KOH, $Mg(OH)_2$, $Ca(OH)_2$, $Sr(OH)_2$ and/or $Ba(OH)_2$ under reaction conditions known in the art. Methods for overbasing which are useful in preparation of the present overbased compounds are exemplified in the art by U.S. Pat. Nos. 3,801,507; 3,446,736; 3,436,347; and 3,350,310; and British Pat. No. 1,121,437.

The overbased compounds of this invention can be used in a wide variety of lubricant media. They can be used as effective agents in lubricating oils such as mineral oils, both naphthenic and paraffinic, including those containing substantial amounts of aromatic oils, synthetic oils, such as synthetic hydrocarbons obtained by polymerizing olefins, synthetic esters and polysiloxanes and the like. The term "lubricant" also includes greases made by adding a grease forming agent to any of those oils mentioned, but is not meant to include any of the overbased compounds themselves as lubricants. The overbased compounds disclosed herein are especially useful in providing detergency and in stabilizing a lubricating oil made by reacting an aliphatic monocarboxylic acid containing from 4 to 10, preferably 5 to 9, carbon atoms with pentaerythritol, including mono- and dipentaerythritol or mixtures thereof. A widely used synthetic lubricating oil in which the present overbased compounds are useful is made from monopentaerythritol and a mixed $C_5$–$C_9$ acid, preferably $C_5$ and $C_9$.

For the purpose of non-limiting illustration of the present invention, the following examples are presented.

EXAMPLE 1

A 90 gram sample of 50% active 1:1 dodecylanilinedodecylphenol sulfide having an average molecular weight of 1200 (i.e., the tetramer) was mixed with 75 grams of diluent oil, 100 cc of methanol and 10 grams of $Ca(OH)_2$. The mixture was heated to 50° C and $CO_2$ gas was bubbled into the mixture for about 2 hours. The methanol was then distilled off as the mixture was allowed to heat up to 160° C. The 160° C temperature was maintained for 1½ hours and then the mixture was filtered over a ¼ inch cake of hiflo filter aid on Whatman #2 filter paper. The yield of filtrate product was 156 grams and it was analyzed to contain 27 weight percent active overbased ingredient, 2.76 weight percent Ca (184 weight percent excess Ca), 0.97 weight percent N and 4.65 weight percent S. The total base number (TBN) of the product was 120. When the product of this example was tested at the 66% active level, the concentration of most commercial overbased phenates, it had a TBN of 290.

EXAMPLE 2

A 153 gram quantity of filtered product was obtained by the procedure of Example 1, but with a 33.5% active material reactant used. The product was determined to have 2.73 weight percent Ca (117 weight percent excess Ca), 1.21 weight percent N and 4.97 weight percent S. The TBN of the product of this example was 122. At the 66% active level, TBN was 244.

EXAMPLE 3

A 90 gram sample of 50% active dodecylphenol-dodecylaniline sulfide (mostly the dimer) was mixed with 30 grams of diluent oil, 10 grams of $Ca(OH)_2$ and 150 ml. of methanol and processed as in Example 1. The filtered product (118 grams) was 35% active and contained 2.12 weight percent Ca (61 weight percent excess Ca), 1.22 weight percent N, 4.01 weight percent S and had a TBN of 116.2.

EXAMPLE 4

A 90 gram sample of the sulfide of Example 3 was mixed with 29 grams of a 50% active neutral petroleum calcium sulfonate (2.04 weight percent Ca, 3.4 weight percent S and 9.6 TBN), 100 ml of methanol and 10 grams of $Ca(OH)_2$ and processed as in Example 1. A quantitative yield of product was obtained which contained 2.64 weight percent Ca (110 weight percent excess Ca), 1.24 weight percent N, 4.47 weight percent S and had a TBN of 118.7.

EXAMPLE 5

A 60 gram sample of dodecylaniline-nonylphenol sulfide (average tetramer) was mixed with 20 grams of Promor #5 process oil, 5 grams of $Ca(OH)_2$ and 90 ml. of methanol and processed as in Example 1. The yield of filtered product was 75 grams (20% active) and it contained 0.98 weight percent Ca (22 weight percent excess Ca), 0.64 weight percent N and 3.0 weight percent S.

EXAMPLE 6

A 50 gram sample of the phenol-aniline sulfide of Example 5 was mixed with 20 grams of Promor #5 process oil, 3 grams of Mg $(OH)_2$, 2 grams of $Ca(OH)_2$ and 90 ml. of methanol and processed as in Example 5. The yield of 19% active filtered product was 62 grams and it contained 1.79 weight percent Ca (110 weight percent excess Ca), 0.57 weight percent N and 3.19 weight percent S.

EXAMPLE 7

A 25 gram sample of 50% active dodecylaniline sulfide (average tetramer) was mixed with 75 grams of 50% active dodecylphenol sulfide (average tetramer), 5 grams $Ca(OH)_2$ and 100 ml. of methanol and processed as in Example 1 to obtain a quantitative yield of product containing 3.12 weight percent Ca (158 weight percent excess Ca), 0.64 weight percent N and 4.04 weight percent S.

EXAMPLE 8

This Example is a duplicate of Example 7 except that the quantity of the aniline sulfide in the mixture was 75 grams and the quantity of the phenol sulfide was 25 grams. The product was found to contain 2.44 weight percent Ca (500 weight percent excess Ca), 1.72 weight percent N, 2.98 weight percent S and to have a TBN of 119.

EXAMPLE 9

A 50 gram sample of the sulfide starting material of Example 1 was mixed with 25 grams of diluent oil, 100 cc of methanol, 1 gram of $Ca(OH)_2$ and 3 grams of $Ba(OH)_2$ and processed as in Example 1. The quantitative yield of filtered product contained 0.9 weight percent Ca and 2.0 weight percent Ba.

The antioxidant properties of the overbased compounds of this invention were measured by adding these compounds to a suitable oil and subjecting the oil to oxidation at high temperatures. The test was a bulk oil catalytic oxidation process in which a stream of dry air was passed through a heated sample of the lubricant composition for a time at various elevated temperatures in the presence of iron, copper, aluminum and lead as catalysts. The metal samples consisted of 15.6 square inches of sand-blasted iron wire, 0.78 square inches of polished copper wire, 0.87 square inches of polished aluminum wire, and 0.167 square inches of polished lead surface. The antioxidant activity was evaluated as the ability of the additive to control the acid number (NN) and viscosity (KV) of the oil and prevent them for rising at an unduly rapid rate. The sludge formation during the oxidation was estimated visually. The base stocks used in this evaluation were (1) a mixed ester of pentaerythritol prepared by reacting an acid mixture of 1 mole of pelargonic acid and 3 moles of commercial valeric acid with 1 mole of technical grade pentaerythritol and (2) a paraffinic stock.

The results of this evaluation are tabulated below in Table I.

TABLE I

TEST OF ANTIOXIDANT PROPERTIES OF PRESENT COMPOUNDS

| Compound of Example | Conc. Wt. % | Temp. ° F. | Time, hours | Δ NN | % Δ KV | Pb Loss, mg | Sludge |
|---|---|---|---|---|---|---|---|
| Synthetic Ester Base Stock | — | 425 | 24 | 5.8 | 226 | 20 | Nil |
| Paraffinic Base Stock | — | 325 | 24 | 17 | 334 | 66 | Heavy |
| 1 in Synthetic Ester Base Stock | 2 | 425 | 24 | 3.9 | 75 | 1.7 | Trace |
| 1 in Paraffinic Base Stock | 2 | 325 | 24 | 4.8 | 26 | 14 | Nil |
| 2 in Paraffinic Base Stock | 2 | 325 | 24 | 7 | 52 | 0.41 | Trace |

The high temperature detergency properties of the compounds of this invention were measured in the Diesel Oil Deposit Simulator Test, the procedure of which was as follows:

A test oil blend comprising a 150 SSU solvent refined mineral oil containing an additive package comprised of overbased sulfonate, overbased phenate and zinc dithiophosphate and an amount of overbased compound herein being tested was preheated to 575° F and pumped into an oil reservoir in which an aluminum shaft was equipped to rotate at constant speed while partially immersed in the oil blend. The atmosphere of the reservoir was a gas mixture flowing at a controlled rate consisting of air mixed with nitrogen oxides and sulfur dioxide. This gas mixture had been previously mixed by passing the various gas streams through a fritted glass bubbler and then through a preheater whereby the mixture became saturated with water. This heated mixed gas stream was introduced into the reactor at a constant rate of 200 liters per hour and at 350° F. The shaft was maintained at a temperature of about 575° F throughout the duration of the test. The shaft was observed for deposit occasioned by the oxidation of the oil which became deposited upon the surface of the rotating shaft. Observations were made after 140 minutes. A rating of 100 indicates a clean surface.

The results of this evaluation are tabulated in Table II below.

TABLE II

DIESEL OIL DEPOSIT SIMULATOR TEST

| Compound of Example | Concentration, wt. % | Test Rating (100 is maximum obtainable) |
|---|---|---|
| Test Oil Blend (without additive compound of present invention) | — | 60 |
| 2 | 2 | 99 |
| 3 | 2 | 95 |
| 4 | 2 | 95 |
| Commercial Overbased phenate | 2 | 91 |
| 50/50 mixture of commercial overbased phenate/Compound of Example 2 (wt/wt) | 2 | 97 |
| 25/75 Mixture of Sulfurized Dodecylaniline/Commercial overbased phenate (wt/wt) | 2 | 93 |
| 75/25 mixture of sulfurized dodecylaniline/commercial overbased phenate (wt/wt) | 2 | 93 |
| 7 | 2 | 95 |
| 8 | 2 | 97 |

What is claimed is:

1. An oil-soluble overbased compound obtained by the process comprising reacting a polyarylamine-arylhydroxy (alkoxy) sulfide having the general chemical formula:

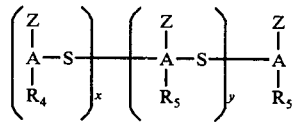

wherein $x$ is an integer of from 1 to about 10;

$y$ is an integer of from 0 to about 10;

A is an aromatic hydrocarbon moiety;

Z is a radical selected from the group consisting of $-NR_1R_2$ and $-OR_3$;

$R_1$ and $R_2$ are alkyl of from 1 to about 10 carbon atoms, aryl, hydrogen,

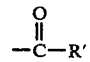

or combinations thereof;

R′ is alkyl of from 1 to about 10 carbon atoms, aryl or hydrogen;

$R_3$ is hydrogen, alkyl of from 1 to about 200 carbon atoms, aryl or alkyl-substituted aryl where the alkyl substituent is comprised of from 1 to about 200 carbon atoms;

$R_4$ is aryl or alkyl-substituted aryl where the alkyl substituent is comprised of from 1 to about 200 carbon atoms;

$R_5$ is alkyl of from 1 to about 200 carbon atoms, aryl or alkyl-substituted aryl where the alkyl substituent is comprised of from 1 to about 200 carbon atoms with one or more basic metallic compounds selected from the group consisting of NaOH, LiOH, KOH, $Mg(OH)_2$, $Ca(OH)_2$, $Sr(OH)_2$ and $Ba(OH)_2$ in the presence of $CO_2$ and methanol.

2. A lubricant composition comprising a major portion of an oil of lubricating viscosity or grease thereof and an oxidation property improving amount of the overbased compound of claim 1.

3. A lubricant composition comprising a major portion of an oil of lubricating viscosity or grease thereof and a detergency property improving amount of the overbased compound of claim 1.

4. The composition of claim 2 comprising a major portion of an oil of lubricating viscosity.

5. The composition of claim 3 comprising a major portion of an oil of lubricating viscosity.

6. The composition of claim 2 comprising a major portion of a grease.

7. The composition of claim 3 comprising a major portion of a grease.

8. The composition of claim 4 wherein the oil of lubricating viscosity is a mineral lubricating oil.

9. The composition of claim 5 wherein the oil of lubricating viscosity is a mineral lubricating oil.

10. The composition of claim 4 wherein the oil of lubricating viscosity is a synthetic lubricating oil.

11. The composition of claim 5 wherein the oil of lubricating viscosity is a synthetic lubricating oil.

12. The composition of claim 10 wherein said synthetic lubricating oil is made from monopentaerythritol and a mixed $C_4$-$C_{10}$ aliphatic monocarboxylic acid.

13. The composition of claim 11 wherein said synthetic lubricating oil is made from monopentaerythritol and a mixed $C_4$-$C_{10}$ aliphatic monocarboxylic acid.

* * * * *